US010809032B1

(12) United States Patent
Thomas et al.

(10) Patent No.: US 10,809,032 B1
(45) Date of Patent: Oct. 20, 2020

(54) LIGHTWEIGHT, DURABLE, HIGH-TEMPERATURE SUSTAINING SOUND SUPPRESSOR DEVICE FOR AUTOMATIC-FIRE SMALL ARMS

(71) Applicant: LOCKHEED MARTIN CORPORATION, Bethesda, MD (US)

(72) Inventors: Toby D. Thomas, Southlake, TX (US); David L. Hunn, Kennedale, TX (US); Kenneth W. Havens, Crowley, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 19 days.

(21) Appl. No.: 16/191,515

(22) Filed: Nov. 15, 2018

Related U.S. Application Data

(60) Provisional application No. 62/587,096, filed on Nov. 16, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/34; F41A 24/36
USPC ..... 89/14.4
See application file for complete search history.

(56) References Cited

U.S. PATENT DOCUMENTS

| | | | | |
|---|---|---|---|---|
| 4,346,643 | A * | 8/1982 | Taylor | F41A 21/44 89/14.1 |
| 5,679,916 | A | 10/1997 | Weichert | |
| 6,358,608 | B1 * | 3/2002 | Hanyon | D02G 3/443 428/362 |
| 8,397,615 | B2 * | 3/2013 | Poling | F41A 13/12 442/136 |
| 9,151,560 | B2 | 10/2015 | Myers et al. | |
| 9,328,984 | B2 | 5/2016 | Shults et al. | |
| D813,971 | S * | 3/2018 | Aragao | D22/108 |
| 9,933,223 | B2 * | 4/2018 | Latka | F41A 21/30 |
| 10,036,606 | B2 * | 7/2018 | Roberts | F41A 21/44 |
| 10,119,779 | B1 * | 11/2018 | Miele | F41A 21/30 |
| 10,386,146 | B2 * | 8/2019 | Spector | F41A 21/482 |
| 10,480,885 | B2 * | 11/2019 | Mohler | F41A 21/30 |
| 2003/0060107 | A1 * | 3/2003 | Gooliak | B32B 15/02 442/131 |
| 2008/0148928 | A1 * | 6/2008 | McClellan | F41A 21/30 89/14.4 |

(Continued)

FOREIGN PATENT DOCUMENTS

WO 2009/139803 11/2009

*Primary Examiner* — Joshua E Freeman
(74) *Attorney, Agent, or Firm* — Terry M. Sanks, Esq.; Beusse Sanks, PLLC

(57) ABSTRACT

A device, comprising a first end cap having a bullet exiting aperture. The device includes a second end cap having an automatic-firing weapon barrel connector. The device includes a tubular sleeve having a main chamber through which a bullet passes, a first end coupled to the first end cap and a second end coupled to the second end cap. The tubular sleeve comprising an insulating liner layer of material configured for sustained temperatures of 1260° C. (2300° F.). The device suppresses sound of a muzzle blast as the bullet passes through the main chamber. A weapon system and method are also provided.

20 Claims, 5 Drawing Sheets

(56) References Cited

U.S. PATENT DOCUMENTS

| | | | | |
|---|---|---|---|---|
| 2011/0100204 | A1* | 5/2011 | Schlenkert | F41A 21/44<br>89/14.1 |
| 2012/0167435 | A1* | 7/2012 | Poling | F41H 3/02<br>42/90 |
| 2015/0241159 | A1 | 8/2015 | Michal et al. | |
| 2017/0153080 | A1* | 6/2017 | Roberts | F41A 21/44 |
| 2017/0299314 | A1* | 10/2017 | Palu | F41A 21/30 |
| 2018/0306546 | A1* | 10/2018 | Roberts | F41C 23/16 |
| 2019/0271520 | A1* | 9/2019 | Roberts | F41C 23/16 |

* cited by examiner

LIGHTWEIGHT, DURABLE, HIGH-TEMPERATURE SUSTAINING SOUND SUPPRESSOR DEVICE FOR AUTOMATIC-FIRE SMALL ARMS

CROSS-REFERENCE TO RELATED APPLICATIONS

This application claims priority benefit of U.S. Provisional Application No. 62/587,096 filed Nov. 16, 2017, to the same inventors, and being incorporated herein by reference as if set forth in full below.

BACKGROUND

Embodiments relate to a high-temperature sustaining sound suppressor device for an automatic-fire small arms weapon or firearm.

Noise suppression of a weapon is a valuable commodity for both the protection of the operator's hearing and the reduction of the noise signature of a weapon. The reduction or change in the noise signature, in some instances, also limits others from quickly or accurately detecting a location and/or type of a fired weapon based on the noise signature of the weapon.

Conventional suppressors may be adequate for non-automatic weapons. However, sustained automatic fire by automatic-fire small arms can deteriorate the effectiveness of the suppressor, including catastrophic failure of the suppressor device with continued firing of the automatic-fired weapon.

SUMMARY

Embodiments relate to a high-temperature sustaining sound suppressor device, system and method.

An aspect of the embodiments includes a device, comprising a first end cap having a bullet exiting aperture. The device includes a second end cap having an automatic-firing weapon barrel connector; and a tubular sleeve having a main chamber through which a bullet passes, a first end coupled to the first end cap, a second end coupled to the second end cap and an insulating liner layer of material. The insulating liner layer of material being configured for sustained temperatures of up to 1260° C. The device is configured to suppress sound of a muzzle blast as the bullet passes through the main chamber.

An aspect of the embodiments includes a weapons system comprising an automatic-firing weapon; and a high-temperature sustaining sound suppressor device. The suppressor device comprises a first end cap having a bullet exiting aperture, a second end cap having a weapon barrel connector for attachment of a barrel of the automatic-firing weapon, and a tubular-shaped heat shield sleeve. The sleeve having a hollow main chamber, a first end coupled to the first end cap, and a second end coupled to the second end cap and a pressure release mechanism below the main chamber. The pressure release mechanism comprises a pressure valve, a pressure release chamber and a pressure release port, the pressure release chamber to channel excess blast exhaust from the main chamber, passing through the pressure valve, away from a path of the bullet and out through the pressure release port oriented to expel the channeled exhaust from a longitudinal side of the sleeve.

Another aspect of the embodiments includes a method comprising firing a plurality of bullets from an automatic-firing weapon; and suppressing a muzzle blast of the plurality of bullets in a sound suppressor device as each bullet passes through the suppressor device. The suppressor device has a main chamber in a tubular sleeve having an insulating liner layer of material to form an internal heat shield. The method includes automatically releasing pressure of excess blast exhaust within the main chamber through a pressure valve to a pressure release chamber and out through a pressure release port, the pressure release chamber to channel the excess blast exhaust away from a path of the bullet and out through the pressure release port oriented to expel the channeled exhaust from a longitudinal side of the sleeve.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1A:
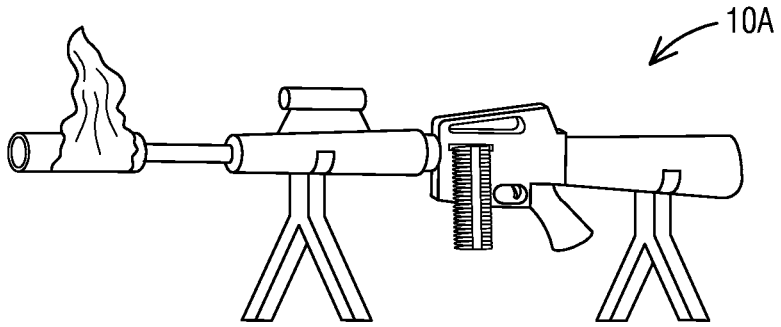
FIGS. 1A, 1B and 1C illustrate images of a conventional sound suppressor device during a meltdown, overheating and rupture, respectively.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Noise suppressors generally cannot sustain high temperatures causing in some instances the material to soften. Once the material softens, the pressure buildup within the noise suppressor causes catastrophic failure, by way of non-limiting example, rupture of, breakage of and/or cracks in the tubular sleeve of the suppressor.

Figure 1B:
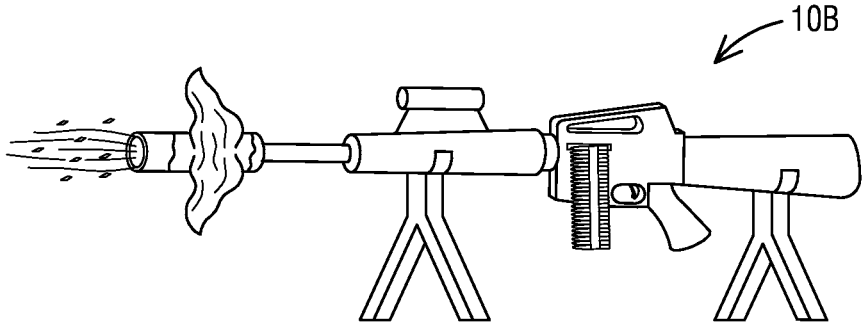
Figure 1C:
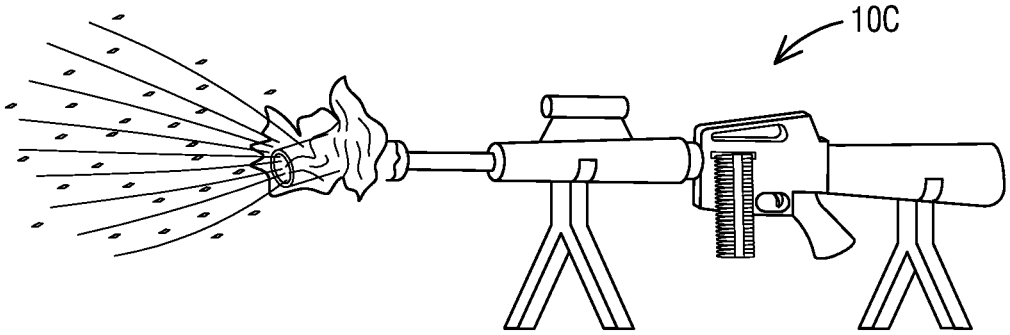

FIG. 1A illustrates image 10A of a conventional sound suppressor device during a meltdown which is hazardous to the operator of the weapon or firearm such as by way of non-limiting example an M240 machine gun firing a 7.62 mm (millimeter) ammunition. FIG. 1B illustrates image 10B of a conventional sound suppressor device during overheating. FIG. 1C illustrates image 10C of a conventional sound suppressor device during a rupture which results in catastrophic failure. The M240 type machine gun has a rate of fire which includes setting for cycling at 650-750 rounds per minute, 750-850 rounds per minute and 850-950 rounds per minute.

The suppressor device of the embodiments herein is configured to sustain high-temperatures limits produced by such rapid-fire rates without rupture or catastrophic failure. The term "sustained high-temperature limit" means that the suppressor device can be repeatedly used over and over at or below a predetermined high-temperature limit without deterioration of performance of the suppressor device. At or below the predetermined high-temperature limit, the material within a tubular sleeve of the suppressor device does not generally ablate or burn.

Figure 2:
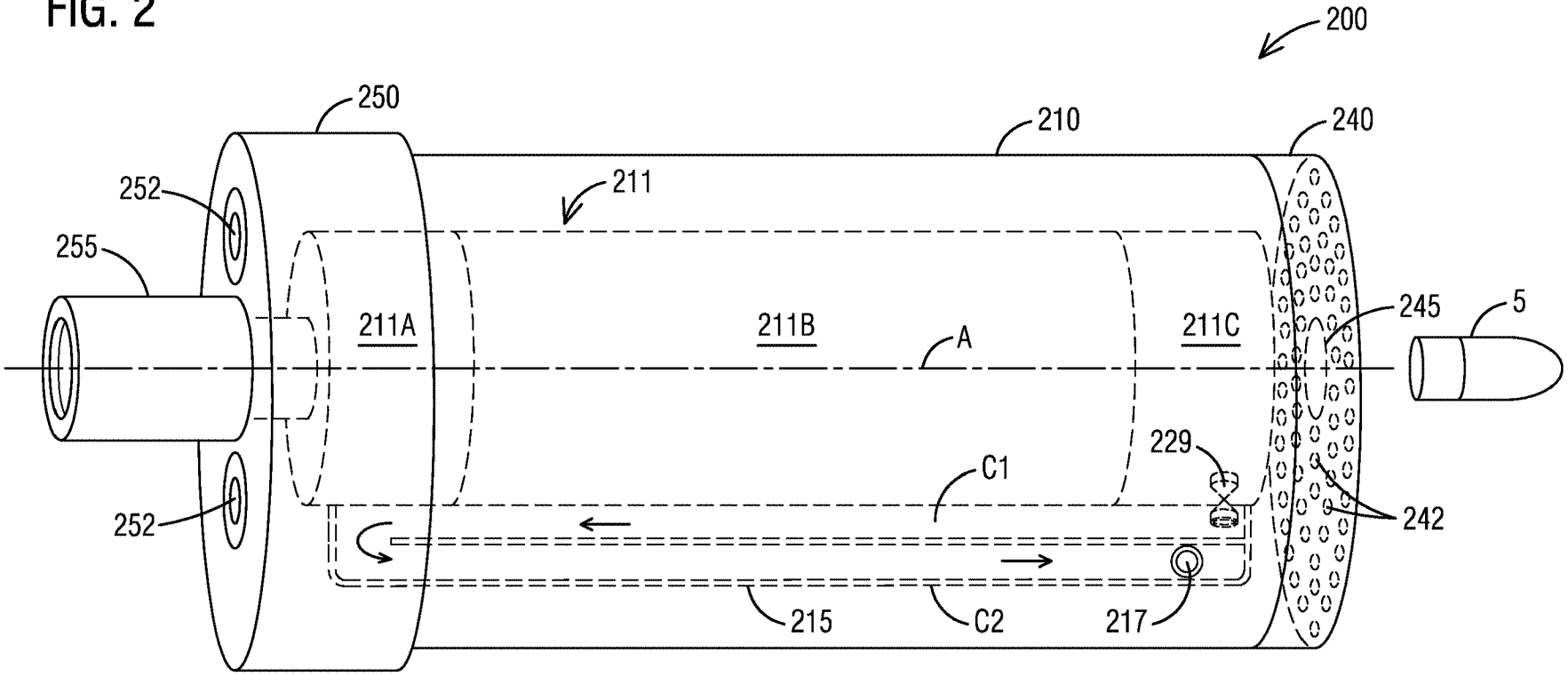
FIG. 2 illustrates a perspective view of the high-temperature sustaining sound suppressor device with internal cavities represented in dashed lines.
Figure 5:
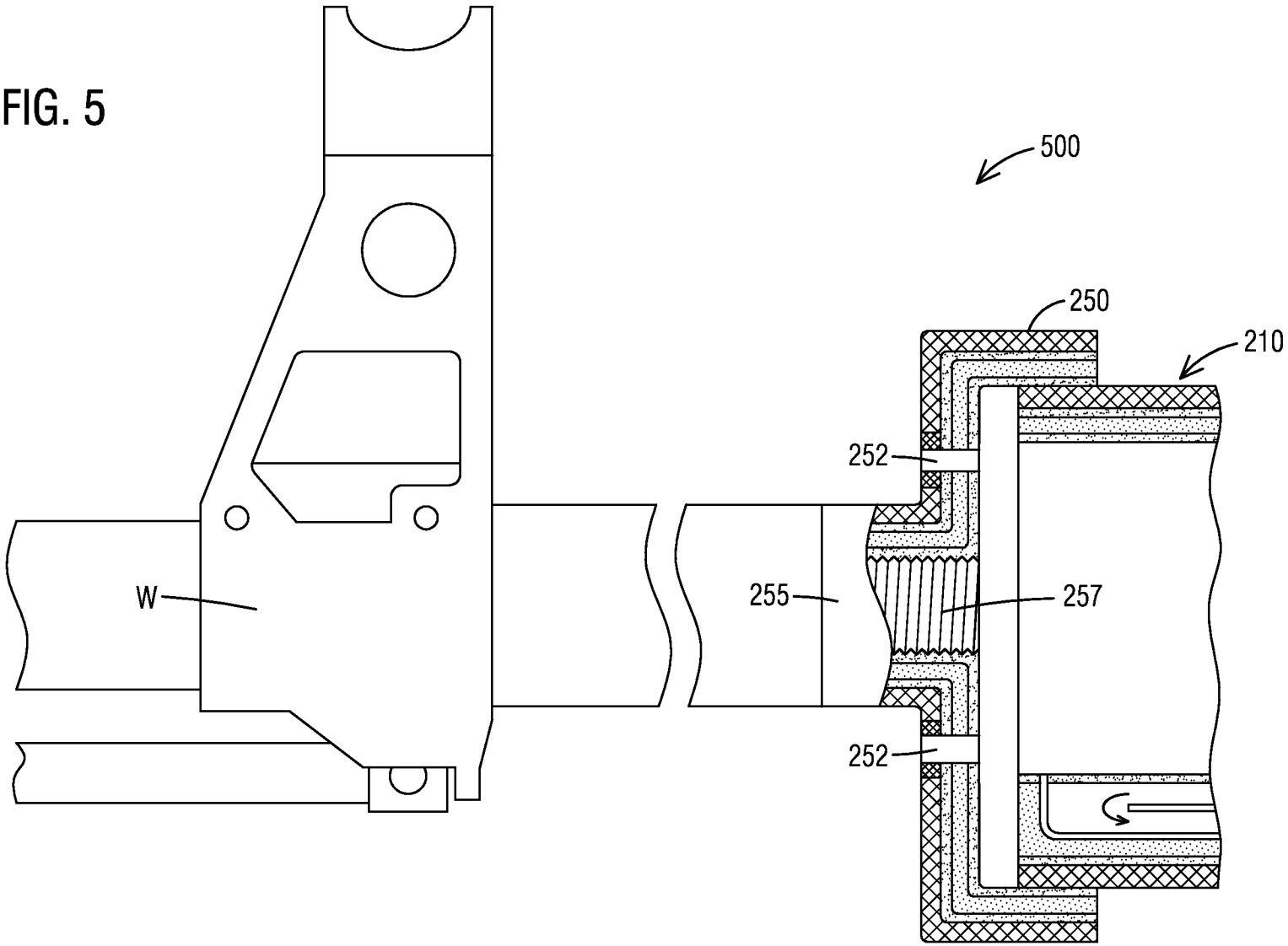
FIG. 5 illustrates a cross-sectional view of an end cap of the high-temperature sustaining sound suppressor device with an automatic-firing weapon of a system.

FIG. 2 illustrates a perspective view of the high-temperature sustaining sound suppressor device 200 with internal cavities represented in dashed lines. Generally, the sound suppressor device 200 is configured to be attached to an end of a barrel of a weapon W, as best seen in FIG. 5, to reduce both the noise (i.e., muzzle sound blast) and the flash generated by the weapon upon firing. The sound suppressor device 200 is constructed and arranged to dissipate of the heat of the flash generally through material selection.

The suppressor device 200 may include a generally tubular sleeve 210, a first end cap 240 and a second end cap 250. The first end cap 240 may be coupled to one distal end of the generally tubular sleeve 210. The second end cap 250 may be coupled to a second distal end of the tubular sleeve 210. The second end cap 250 is configured to couple to the barrel of the weapon W, as will be described in more detail in relation to FIG. 5, via barrel connector 255. The second end cap 250 may include one or more apertures or vents 252 to release some amount of heat and sound out of the generally tubular sleeve 210. The sound of the blast from firing the weapon W is muzzled by the suppressor device 200. While the heat within the generally tubular sleeve 210 is dissipated by material selection, the burning gasses passing through the tubular sleeve 210 from the cartridge firing the ammunition may pass out through the tubular sleeve 210 via one or more pressure release mechanisms, as will be described in more detail below.

The first end cap 240 may include an aperture 245 (shown in phantom) through which the ammunition or bullet 5 will exit the suppressor device 200 after traveling through the second end cap 250, tubular sleeve 210 and the aperture 245 of the first end cap 240. The first end cap 240 may also include vent ports 242 denoted in phantom surrounding aperture 245. The vent ports 242 and/or apertures or vents 252 may serve as a first pressure release mechanism. The vent ports 242 may atomize any gases or under pressure fluid exiting the vent ports 242. In some embodiments, vent ports 242 may be have holes or pathways which are angled 30 or 40 degree relative to the center axis A. The aperture 245 is a bullet exiting aperture.

The generally tubular sleeve 210 may include a main chamber portion 211, denoted in dashed lines. The main chamber portion 211 may include a rear expansion chamber (REC) area 211A; a center chamber (CC) area 211B; and a forward expansion chamber (FEC) area 211C, as will be discussed in relation to FIG. 4. The suppressor device 200 may comprise a pressure release chamber 215 being generally parallel to, separate from, and/or below the main chamber portion 211 and within the tubular sleeve 210. The main chamber portion 211 may have a generally hollow cylindrical profile. The pressure release chamber 215 may be integrated in the tubular sleeve 210 along a bottom side of the main chamber portion 211. Thus, the tubular sleeve 210 may become oblong in the direction of the pressure release chamber 215 while maintaining a symmetrically hollow cylinder profile of the main chamber portion 211.

The main chamber portion 211 may include a center axis A corresponding to the path through which the ammunition or bullet 5 will travel into the main chamber portion 211 and out through aperture 245. In some embodiments, the tubular sleeve 210 may have a quasi-cylindrical shape or profile with the main chamber portion 211 being an internal hollow cylinder cavity within the tubular sleeve 210.

The pressure release chamber 215 has an inlet controlled by a pressure valve 229 and an outlet to pressure release port 217 radiating from the side of the tubular sleeve 210. For the sake of brevity, both the inlet and the pressure valve will generally be referenced by the numeral 229 in the figures. The pressure release port 217 is denoted as a tube or channel within and extending out from the tubular sleeve 210. For the sake of brevity, the outlet and the pressure release port 217 will generally be referenced by the numeral 217 in the figures.

The pressure release chamber 215 includes a first channel C1 and a second channel C2 being generally parallel to the first channel C1. The first channel C1 and the second channel C2 are generally divided by a dividing wall within the pressure release chamber. The aft end of the dividing wall is shorter than the total length of the pressure release chamber 215 to merge or loop the paths of the first channel C1 and the second channel C2 together. The channels C1 and C2 are both generally parallel to and stacked below the main chamber portion 211. In some embodiments, the first and second channels C1 and C2 are stacked below each other. The inlet of the pressure release chamber 215 is in fluid communication with the first channel C1 via the valve 229 located in close proximity to the forward expansion chamber (FEC) area 211C. The blast pressure may flow through the valve 229 to the first channel C1 at the forward end of the suppressor device 200. The forward end of the suppressor device 200 corresponds to the ammunition or bullet 5 exit out from the suppressor device 200.

Figure 4:
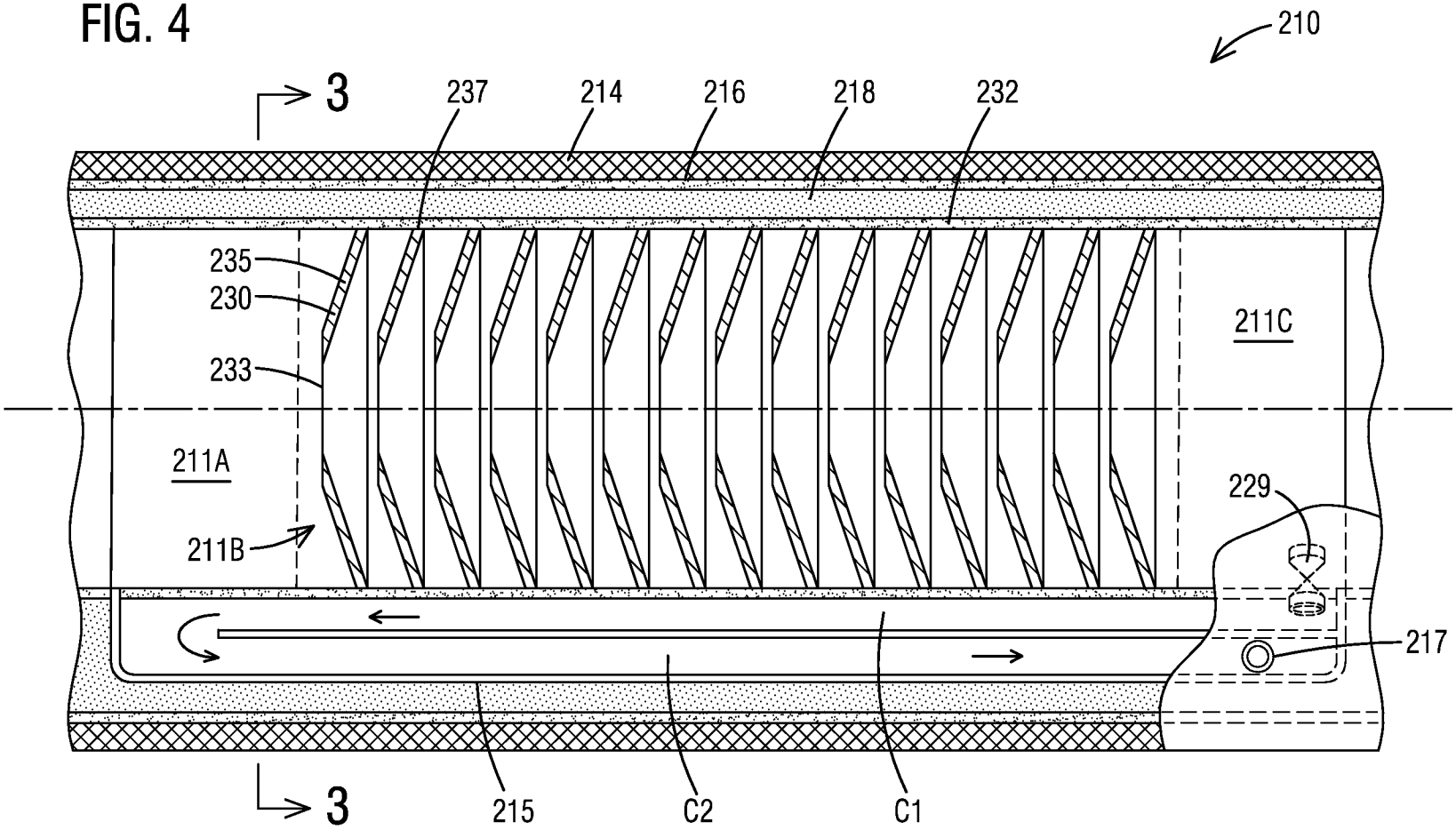
FIG. 4 illustrates a cross-sectional view of the tubular sleeve and baffle walls of the high-temperature sustaining sound suppressor device of FIG. 2.

The second channel C2 may include an outlet to pressure release port 217. The channel walls including the dividing wall of the pressure release chamber 215 may be made of carbon-carbon materials. The baffle walls, as best seen in FIG. 4, may be made of carbon-carbon materials.

The pressure release port 217 is shown positioned in proximity to the forward (front) end of the pressure release chamber 215 so that the blast exhaust can exit the suppressor device 200. The positioning of the port 217 may serve to locate the outlet/port 217 at a location generally farthest away from the user and which projects either horizontally (parallel to the horizon) or at an angle above the horizon. The pressure release port 217 may be oriented so that any exhaust from the port 217 is focused sideways, such as parallel to the horizon, but away from the direction of the eyes of the user or the aperture 245. Orienting the port 217 sideways projects the flash of the blast exhaust away from the path of the user's eyes. Orienting the port 217 to project to the side minimizes the force field of the exiting blast exhaust from interfering with the flight path of the ammunition or bullet 5 as it exits the suppressor device 200.

The first pressure release mechanism may include the vent ports 242 and, a second pressure release mechanism may include the pressure release chamber 215, pressure valve 229 and exiting pressure release port 217. In some embodiments, the pressure valve 229 may be a flapper valve or a spring biased valve configured to open after a predetermined amount of pressure is applied to a valve flapper (not shown).

While only a single pressure release port 217 and single valve 229 are shown, the suppressor device 200 may include opposing pressure release ports 217 and valves 229 to release pressure from the pressure release chamber 215 from opposite longitudinal sides of the tubular sleeve 210. The release port 217 may be made of carbon-carbon or other material used for the first layer of material.

In some embodiments, the pressure release port 217 may be oriented so that any exiting or expelled gases are not generally directed toward the ground. Jetting gases if directed toward the ground, during outdoor use, may cause a dust cloud, giving away the location of the shooter. Therefore, the pressure release port 217 may be configured or oriented to jet those gases being expelled from the pressure release chamber 215 either generally parallel to the horizon or at an angle directed above the horizon. In some embodiments, the pressure release port 217 may be essentially perpendicular to the plane of the longitudinal axis of the tubular sleeve 210. Thus, when the longitudinal axis of the tubular sleeve 210 is parallel to the horizon, the pressure release port 217 may be essentially perpendicular to the plane of the longitudinal axis, but parallel to the horizon.

In operation, over pressure blast exhaust opens the valve 229 and the pressurized blast exhaust travels back to the aft (rear) end of the tubular sleeve 210 in the first or upper channel C1. At the aft end of channel C1, the pressurized blast exhaust flow path is looped to, merged with the second (lower) pressure chamber C2 to move forward in the back toward the front end of the second (lower) pressure chamber C2. The excess pressurized blast exhaust exits the tubular sleeve 210 or the second pressure chamber C2 through port 217. The "front end" or "forward end) of the second (lower) pressure chamber C2 corresponds to or is in close proximity to the end of the suppressor device 200 through which the bullet or ammunition exits.

Figure 3:
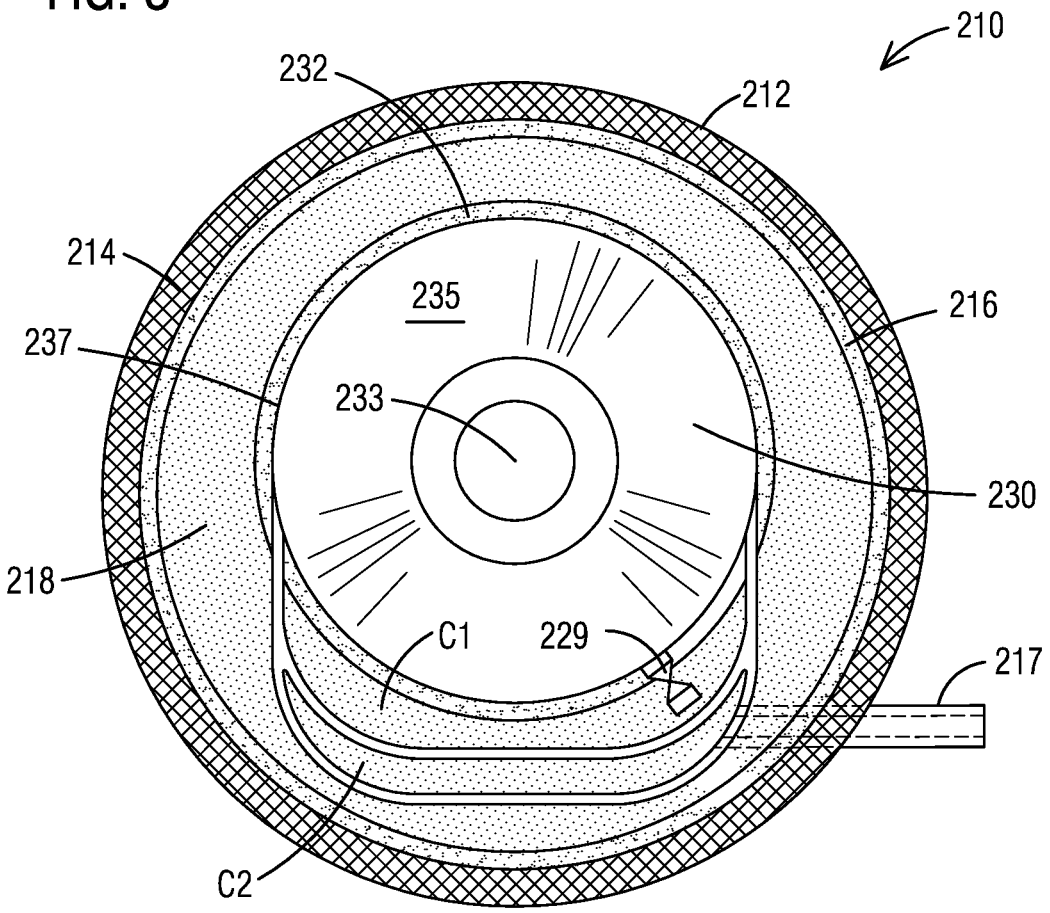
FIG. 3 illustrates an end view of the tubular sleeve of the suppressor device of FIG. 2.

FIG. 3 illustrates an end view of the tubular sleeve 210 of the suppressor device of FIG. 2 and with baffle walls 230 added. FIG. 4 illustrates a cross-sectional view of the tubular sleeve 210 and baffle walls 230 of the high-temperature sustaining sound suppressor device of FIG. 2. The tubular sleeve 210 includes a first layer of material 214 and a second layer of material 218. The first and second layers of material 214 and 218 are configured to be attached to each other. The first layer of material 214 is represented as a cross hatched area. The second layer of material 218 is represented as a dotted hatch area. In the illustration, an attachment layer of material 216 between the first and second layers of material 214 and 218 may be provided. The layer of material 216 may include adhesive material, bonding material, or other material suitable to facilitate the permanent attachment of the first layer of material 214 to the second layer of material 218.

For sustained thermal resistance as a result of automatic-fired weapons, the first layer of material 214 may include carbon fiber reinforced carbon, carbon-carbon, or reinforced carbon-carbon, all of which refer to a carbon-carbon material such as used in spacecraft such as, without limitation, the nose cone of the Space Shuttle orbiter or the nose cone of an Intercontinental Ballistic Missile. The reinforced carbon-carbon is a composite material including carbon fiber reinforcement in a matrix of graphite. The first layer of material 214 may include carbon/SiC (silicon carbide), or the like. The first layer material 214 may have a low coefficient of thermal expansion for high-temperature applications compatible with (meeting or exceeding) the temperature range of the fibrous ceramic insulation material for sustained operation and the short-term exposure temperature limits. An interior surface of the first layer of material 214 is lined with the second layer of material 218 for further heat resistance. The second layer of material 218 being a heat resistant material for lining the tubular sleeve 210 of the suppressor device 200. By way of non-limiting example, the second layer of material 218 may be an insulating material used for missile-type solid-propellant motors and may serve as a high-temperature heat shield. The outer surface 212 (FIG. 3) of the tubular sleeve 210 may be able to be touched by the operator of the weapon without burning the unaided hand or skin in direct contact with the outer surface 212.

The tubular sleeve 210 being configured to suppress the noise signature of a weapon W, withstand both the force of a weapon's muzzle blast as well as the increased heat load of sustained automatic-fire of the weapon W. The aerospace materials are configured to withstand the high-temperatures created by the sustained rate of fire of 100 RPM (rounds per minute), a rapid rate of fire of 200 RPM and/or a cyclic rate of fire of 800 RPM of an operational setting. A standard rapid-fire belt may have 100 rounds and can be linked in series together with other belts. A full cycle of the weapon, for an 800 RPM barrel, can be controlled to balance approximately 10 or 15 rounds a second or so between short bursts to allow the weapon's barrel to remove heat between the consecutive short bursts. However, the weapon's barrel may burn out (ablate) along the interior surface and, subsequently, fail as high heat is generated within the barrel as the bullets spin and travel along the length of the barrel. Normal expenditure from a belt may be 100 rounds per minute, for example. A rapid fire may be 200 rounds per minute with the weapon set at 800 rounds per minute (operational setting). A gunner limits the rounds per minute (RPM) of the weapon set at 800 rounds to approximately 200 rounds per minute to allow for cooling.

The tubular sleeve 210 is configured to house therein one or more baffle walls 230. The center of the baffle wall 230 includes a pass-through aperture 233 for the bullet 5 aligned with the axis of the barrel of the weapon W and the center axis A (FIG. 2) of the main chamber portion 211. The surfaces 235 may be sloped, as best seen in FIG. 4, and may serve to create a diffractor chamber between baffle walls 230. The baffle wall 230 includes radial edges 237 which may be attached to the second layer of material 218 via attachment layer of material 232. The attachment layer of material 232 may include adhesive, bonding material, etc. The pass-through aperture 233 may have a diameter of 10.5 mm (millimeters), for example.

For the heat resistant material for lining the tubular sleeve 210, the second layer of material 218 may include fibrous ceramic insulation material such as, without limitation, FIBERFRAX® HSA™ Paper Composite Systems which are a unique ceramic fiber insulation used in the fabrication of a high-temperature heat shield and is suitable for continuous use at temperatures of up to approximately 1260° C. (Celsius) or 2300° F. (Fahrenheit) and, in some cases, short-term exposure to temperatures up to the material's softening point which may be greater than approximately 1649° C. (3000° F.). The FIBERFRAX HSA Paper Composite System may include high purity alumina-silica fibers with a small cell structure configured to provide extremely low thermal conductivity. The fibrous insulation material may also provide a high resistance to mechanical and acoustical vibration. While not wishing to be bound by theory, the fibrous insulation material may aid in noise suppression. The second layer of material 218 of fibrous ceramic insulation material is generally lightweight and is available in thicknesses of ⅛, ¼, ⅜, and ½ inches. The continuous use temperatures may be in the range of 2000° F.-2300° F. The melting or softening point may be in the range of 3000° F.-3260° F. The second layer of material 218 may sometimes be referred to as an insulating liner layer of material 218 which essentially forms an internal heat shield.

The term "short-term" may correspond to 2-5 minutes wherein operation of the suppression device 200 (FIG. 2) above 2300° F. may heat up to the second layer of material 218 to its melting or softening point for a duration at which failure occurs. The carbon-carbon materials are known to retain their properties at temperatures up to 2000° C., for example. The carbon-carbon materials may also retain their properties at high temperatures above 2000° C. Therefore, carbon-carbon materials including, without limitation, carbon fiber reinforcement in a matrix of graphite for the baffle walls construction may be selected to meet or exceed both the temperature limits for the sustained use operating temperature of approximately 1260° C. and the short-term exposure temperatures of at least 1649° C. or the melting or softening temperature(s) of the insulating liner layer of material 218.

The low coefficient of thermal expansion of the carbon-carbon material allow the baffle walls to retain their shape at high temperatures. Therefore, during rapid-fire operation, the baffle walls while heated retain their shape at least up to 2000° C. Other materials which match the operating temperatures for both the sustained use and the short-term exposure or the operating temperatures of the heat shield, while retaining their properties may be used.

Along the lower half of the tubular sleeve 210 includes the first and second channels C1 and C2 with the port 217 exiting the second channel C2, previously described in relation to FIG. 2. Thus, no further description is needed.

The second layer of material 218 may, in some embodiments, surround the outer wall of the second channel C2, as shown in FIG. 4. Any required attachment layers of material are not shown between the walls of the second channel C2 and the insulating liner layer of material 218. In other embodiments, the insulating liner layer of material 218 may be arranged on the interior side of the first channel C1 adjacent to the main chamber 211. Nonetheless, the walls of the first and second channels C1 and C2 may be made of materials which retain their properties at temperatures meeting or exceeding the melting or softening point of the insulating liner layer of material 218.

With reference to FIG. 4, a center chamber (CC) area 211B may have a length to accommodate a set of baffles walls 230 configured to match the acoustic properties and to suppress the noise signature of the weapon and/or bullet 5. The baffle wall 230 may be made of carbon-carbon material. The baffle walls 230 may have a conical center created by the sloped to tapered surface 235. The first end cap 240 (FIG. 2) may be configured with the same material as baffle walls 230 and may include the material layers of the tubular sleeve 210. However, the exterior surface of the first end cap 240 and the second end cap 250 may be made of carbon-carbon material to match the outer layer of the tubular sleeve 210. In some embodiments, the end caps are lined with the insulating liner layer of material 218. In other embodiments, the lining on the end caps is omitted. The second cap 250 has a diameter larger than the diameter of the tubular sleeve 210 such that end of the tubular sleeve 210, as best seen in FIGS. 2 and 5, is received in and affixed to the inner annulus of the second end cap 250. The first end cap 250 may be affixed to an end of the sleeve 210. The rear or aft expansion chamber (REC) area 211A is an area rear of the set of baffle walls 230 and extending to the second end cap 250 in the direction to the aft end of the tubular sleeve 210. The forward expansion chamber (FEC) area 211C is an area which begins generally after the forwardmost baffle wall of the set extending to the first end cap 240. In some embodiments, one of the first end cap 240 and the second end cap 250 may be integrally formed with the tubular sleeve 210.

FIG. 5 illustrates a cross-sectional view of the second end cap 250 of the high-temperature sustaining sound suppressor device with an automatic-firing weapon W attached in a weapon system 500. The second end cap 250 includes one or more apertures 252 formed in an end surface of the cap 250 to release amounts of heat and sound from the tubular sleeve 210. The sound of the blast from firing the weapon W is muzzled by the suppressor device. The barrel connector 255 includes internal threads for attachment to threads 257 on an end of the weapon's barrel. The diameter of the second end cap 250 may have an outside diameter of approximately 2 inches in some embodiments. The weapon system 500 includes an automatic-fire weapon W and the suppressor device 200 described herein.

The second end cap 250 is shown with the first and second layers of material 214 and 218. Nonetheless, the insulating liner layer of material 218 may be omitted in some embodiments. The second end cap 250 is affixed or bonded to the aft end of the tubular sleeve 210. Suppressors have been limited in use in the United States (US) since the National Firearms Act of 1934. It has only been recently that concern for protecting user's hearing has given a boost to the numbers of suppressors in use in the US. The inventors have determined that aerospace materials are designed for high heat temperatures for longer periods of time than conventional materials used in suppressors. The aerospace materials surpass any metal alloys in resistance to the effects of heat to prevent failure or meltdown. Thus, sound protection is extended by the sustained high-temperature of operation that extends the useful life of materials of the suppressor device used with automatic-fired weapons to minimize or prevent catastrophic failure and/or meltdown. Thus, material for rocket propulsion motors are suitable for high heat temperatures.

A Hearing Protection Act of 2017 has been introduced in the House of Representatives (Jan. 9, 2017) to address the use of a firearm silencer with proposed elimination or reduction in transfer taxes. While silencers protect hearing, conventional suppressors do not perform well with automatic-fire weapons.

The method of manufacture follows standard manufacturing processes associated with monolithic ceramic materials or high-temperature composite materials (such as carbon/carbon, carbon/SiC (silicon carbide), or the like).

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

We claim:

1. A device, comprising:

a first end cap having a bullet exiting aperture;

a second end cap having a weapon barrel connector; and a tubular sleeve having a plurality of material layers to define a main chamber through which a bullet passes, a first end coupled to the first end cap, a second end coupled to the second end cap and the plurality of material layers comprising first layer of material having a composite material including carbon fiber reinforcement in a matrix of graphite and an insulating liner layer of material being configured for sustained temperatures up to 1260° C. coupled to an interior surface of the first layer of material to insulate the first layer of material, and to suppress sound of a muzzle blast from the bullet passing through the main chamber.

2. The device of claim 1, wherein the insulating liner layer of material of the tubular sleeve is made of materials configured for short-term exposure of up to 5 minutes at temperatures greater than 1649° C. or at temperatures of a softening point of the insulating liner layer material.

3. The device of claim 1, further comprising a set of baffle walls coupled to an interior surface of the tubular sleeve and being configured to suppress a noise signature of the bullet passing through the main chamber.

4. The device of claim 3, wherein surfaces of the set of baffle walls are made of a composite material including carbon fiber reinforcement in a matrix of graphite.

5. The device of claim 4, wherein the insulating liner layer of material includes fibrous ceramic insulation material forming a heat shield having the sustained temperatures up to 1260° C. and resistance to acoustical vibrations; and the composite material having thermal properties meeting or exceeding thermal properties of the fibrous ceramic insulation material.

6. The device of claim 1, wherein the weapon barrel connector is a barrel connector for an automatic-firing weapon.

7. The device of claim 1, further comprising a pressure release mechanism below the main chamber, the pressure release mechanism comprises a pressure valve, a pressure release port and a pressure release chamber being configured to channel excess blast exhaust from the main chamber, passing through the pressure valve, away from a path of the bullet and out through the pressure release port oriented to expel the exhaust from a side of the tubular sleeve.

8. A system, comprising:

an automatic-firing weapon; and a high-temperature sustaining sound suppressor device comprising:

a first end cap having a bullet exiting aperture through which a bullet exits;

a second end cap having a weapon barrel connector for attachment of a barrel of the automatic-firing weapon and through which the bullet enters; and a tubular-shaped heat shield sleeve having a hollow main chamber, a first end coupled to the first end cap, and a second end coupled to the second end cap and a pressure release mechanism below the main chamber, the pressure release mechanism comprises a pressure valve, a pressure release chamber and a pressure release port, the pressure release chamber to channel excess blast exhaust from the main chamber, passing through the pressure valve, away from a path of the bullet and out through the pressure release port oriented to expel the channeled exhaust from a longitudinal side of the sleeve.

9. The system of claim 8, wherein the tubular-shaped heat shield sleeve comprising an insulating liner layer of material forming a heat shield configured for short-term exposure of up to 5 minutes at temperatures greater than 1649° C. or at temperatures at a softening point of the insulating liner layer material.

10. The system of claim 8, further comprising a set of baffle walls coupled to an interior surface of the main chamber and being configured to suppress a noise signature of the bullet passing through the main chamber.

11. The system of claim 10, wherein the tubular-shaped heat shield sleeve comprising a first layer of material, wherein the first layer of material and surfaces of the set of baffle walls are made of composite material including carbon fiber reinforcement in a matrix of graphite; and an insulating liner layer of material forming a heat shield layer coupled to an interior surface of the first layer of material to insulate the first layer of material.

12. The system of claim 11, wherein the insulating liner layer of material includes fibrous ceramic insulation material configured for sustained temperatures of up to 1260° C. and resistance to acoustical vibrations; and the first layer of material configured to meet or exceed the thermal operating temperatures of the insulating liner layer of material.

13. The system of claim 8, wherein the weapon barrel connector is an automatic-firing weapon barrel connector.

14. The system of claim 8, further comprising a plurality of vents formed in the first end cap to vent the main chamber.

15. A device, comprising:

a first end cap having a bullet exiting aperture;

a second end cap having a weapon barrel connector;

a tubular sleeve having a main chamber through which a bullet passes, a first end coupled to the first end cap, a second end coupled to the second end cap and an insulating liner layer of material, being configured for sustained temperatures up to 1260° C., and to suppress sound of a muzzle blast from the bullet passing through the main chamber; and a pressure release mechanism below the main chamber, the pressure release mechanism comprises a pressure valve, a pressure release port and a pressure release chamber being configured to channel excess blast exhaust from the main chamber, passing through the pressure valve, away from a path of the bullet and out through the pressure release port oriented to expel the exhaust from a side of the tubular sleeve.

16. The device of claim 15, wherein the insulating liner layer of material of the tubular sleeve is made of materials configured for short-term exposure of up to 5 minutes at temperatures greater than 1649° C. or at temperatures of a softening point of the insulating liner layer material.

17. The device of claim 15, further comprising a set of baffle walls coupled to an interior surface of the tubular sleeve and being configured to suppress a noise signature of the bullet passing through the main chamber.

18. The device of claim 17, wherein surfaces of the set of baffle walls are made of a composite material including carbon fiber reinforcement in a matrix of graphite.

19. The device of claim 18, wherein the insulating liner layer of material includes fibrous ceramic insulation material forming a heat shield having the sustained temperatures up to 1260° C. and resistance to acoustical vibrations; and the composite material having thermal properties meeting or exceeding thermal properties of the fibrous ceramic insulation material.

20. The device of claim 15, wherein the weapon barrel connector is a barrel connector for an automatic-firing weapon.

* * * * *